US010612876B2

(12) United States Patent
Kim

(10) Patent No.: US 10,612,876 B2
(45) Date of Patent: Apr. 7, 2020

(54) ADJUSTABLE FORCE REPLACEABLE SLIDE NOTCH SYSTEM

(71) Applicant: Kyung Tae Kim, Laguna Niguel, CA (US)

(72) Inventor: Kyung Tae Kim, Laguna Niguel, CA (US)

(73) Assignee: KMM ENGINEERING, INC., Laguna Hills, CA (US)

( * ) Notice: Subject to any disclaimer, the term of this patent is extended or adjusted under 35 U.S.C. 154(b) by 0 days.

(21) Appl. No.: 16/241,865

(22) Filed: Jan. 7, 2019

(65) Prior Publication Data

US 2019/0137205 A1 May 9, 2019

(51) Int. Cl.

| | |
|---|---|
| ***F41A 17/36*** | (2006.01) |
| ***F41A 3/66*** | (2006.01) |
| ***F41A 17/40*** | (2006.01) |

(52) U.S. Cl.

CPC ..... *F41A 17/36* (2013.01); *F41A 3/66* (2013.01); *F41A 17/40* (2013.01)

(58) Field of Classification Search

CPC ..... F41A 3/42; F41A 9/38; F41A 9/39; F41A 9/40; F41A 9/41; F41A 17/36; F41A 17/40

USPC ..... 42/16, 17, 18, 19; 89/190

See application file for complete search history.

(56) References Cited

U.S. PATENT DOCUMENTS

| | | | | | |
|---|---|---|---|---|---|
| 2,832,266 | A * | 4/1958 | Sunderland | F41A 21/485 | 89/195 |
| 3,715,826 | A | 2/1973 | Seifried | | |
| 4,176,584 | A * | 12/1979 | Thomas, Jr. | F41A 17/38 | 89/138 |
| 4,420,899 | A | 12/1983 | Bourlet | | |
| 4,549,465 | A * | 10/1985 | Charron | F41A 17/36 | 89/138 |
| 4,575,963 | A * | 3/1986 | Ruger | F41A 19/48 | 42/70.08 |
| 4,594,935 | A | 6/1986 | Smith | | |
| 5,131,317 | A | 7/1992 | Meller | | |
| 5,216,191 | A * | 6/1993 | Fox | F41A 3/12 | 42/70.05 |
| 5,473,834 | A | 12/1995 | Bammate | | |
| 5,483,766 | A * | 1/1996 | Hochstrate | F41C 23/10 | 42/71.02 |
| 6,408,905 | B1 | 6/2002 | Lee | | |
| 6,606,811 | B1 | 8/2003 | Olson | | |
| 6,898,888 | B2 | 5/2005 | Greenhut | | |
| 8,033,043 | B2 | 10/2011 | Mcgarry | | |
| 8,061,255 | B1 | 11/2011 | Boberg | | |
| 2005/0247187 | A1 * | 11/2005 | McGarry | F41A 3/86 | 89/198 |
| 2010/0170132 | A1 | 7/2010 | Zukowski | | |

(Continued)

*Primary Examiner* — Bret Hayes

(74) *Attorney, Agent, or Firm* — Fish IP Law, LLP

(57) ABSTRACT

A replaceable slide notch system for a firearm that includes a replaceable slide notch component dimensioned to fit within a corresponding cavity of a slide. The replaceable slide notch component includes a slide lock notch surface that locks the slide when the firearm's ammunition is exhausted. A second replaceable slide notch component has a second slide lock notch surface that locks the slide at a further rearward position than that of the first slide notch component, thus providing greater chambering/operating force when the slide is released.

8 Claims, 18 Drawing Sheets

(56) References Cited

U.S. PATENT DOCUMENTS

| | | | | |
|---|---|---|---|---|
| 2010/0170138 | A1 | 7/2010 | Zukowski | |
| 2010/0281735 | A1* | 11/2010 | Kallio | F41A 15/16 42/25 |
| 2015/0033608 | A1 | 2/2015 | Power | |
| 2015/0096212 | A1* | 4/2015 | Curry | F41A 17/36 42/16 |
| 2016/0069627 | A1 | 3/2016 | Cobb | |

* cited by examiner

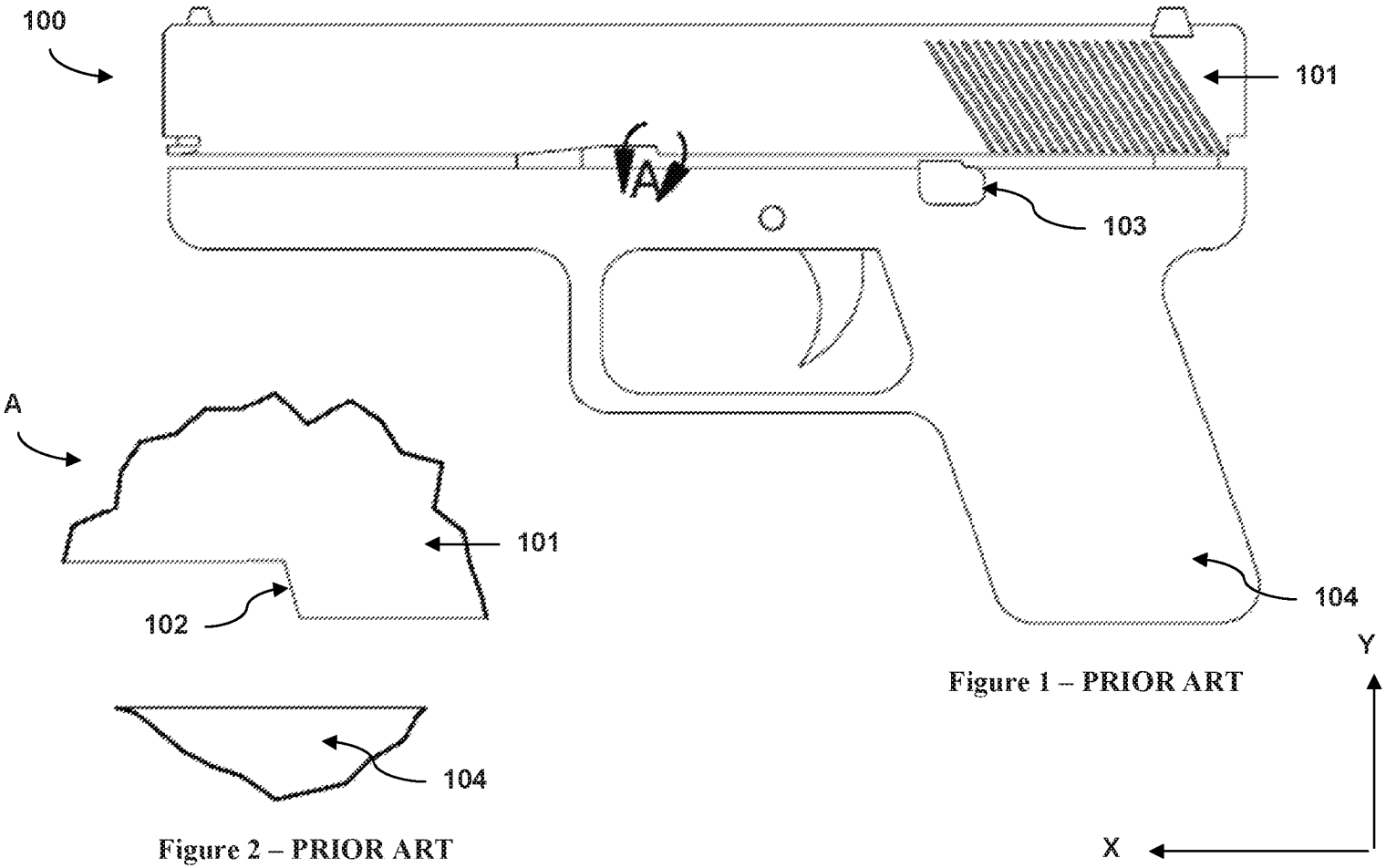
Figure 1 – PRIOR ART
Figure 2 – PRIOR ART

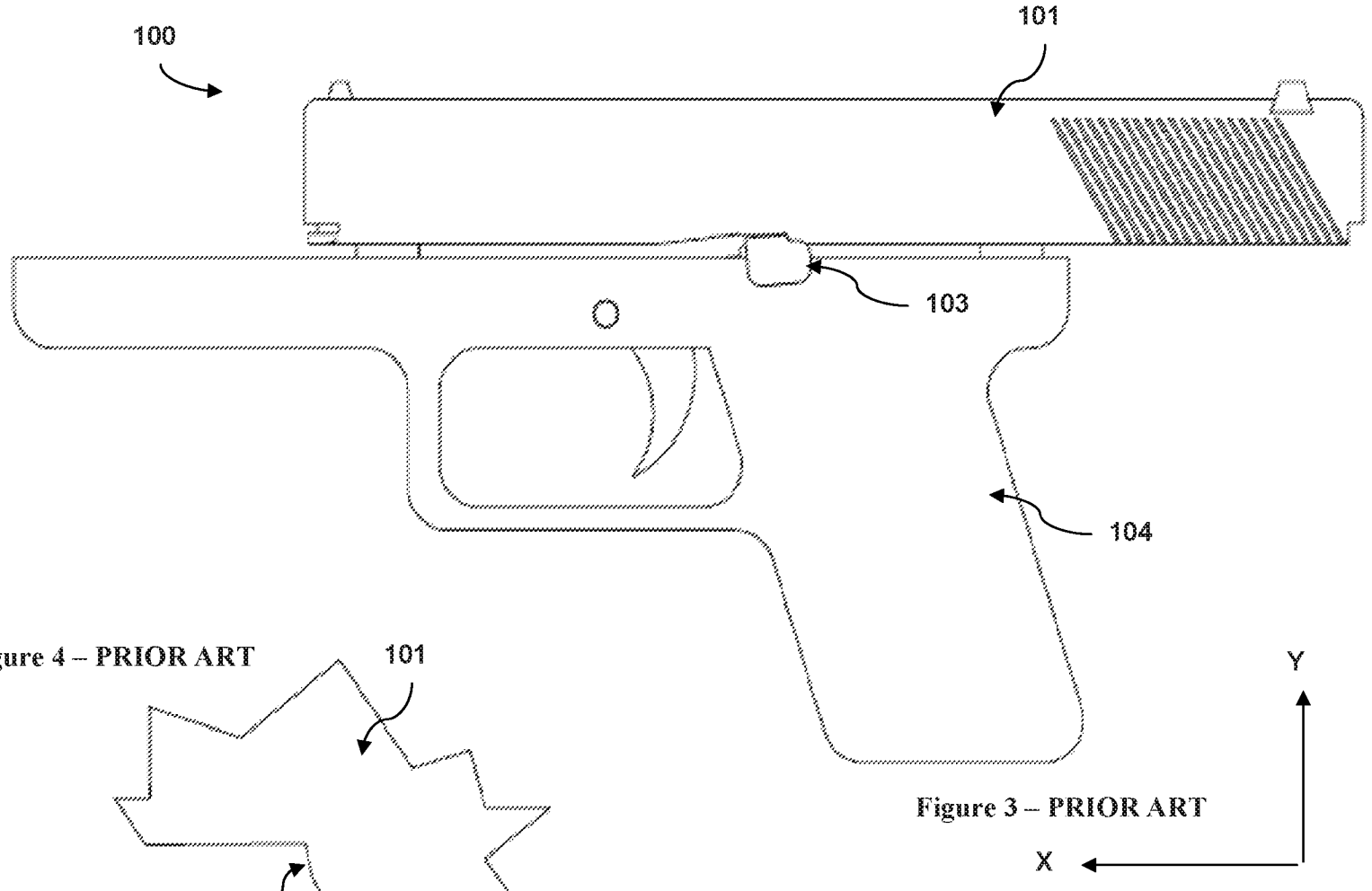
Figure 3 – PRIOR ART
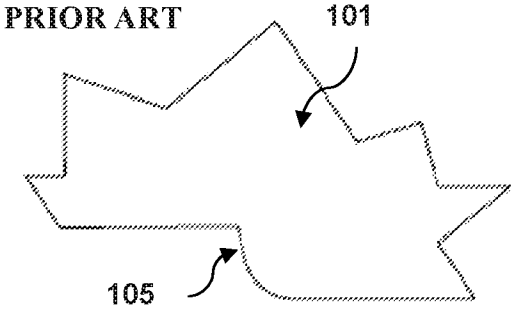
Figure 4 – PRIOR ART

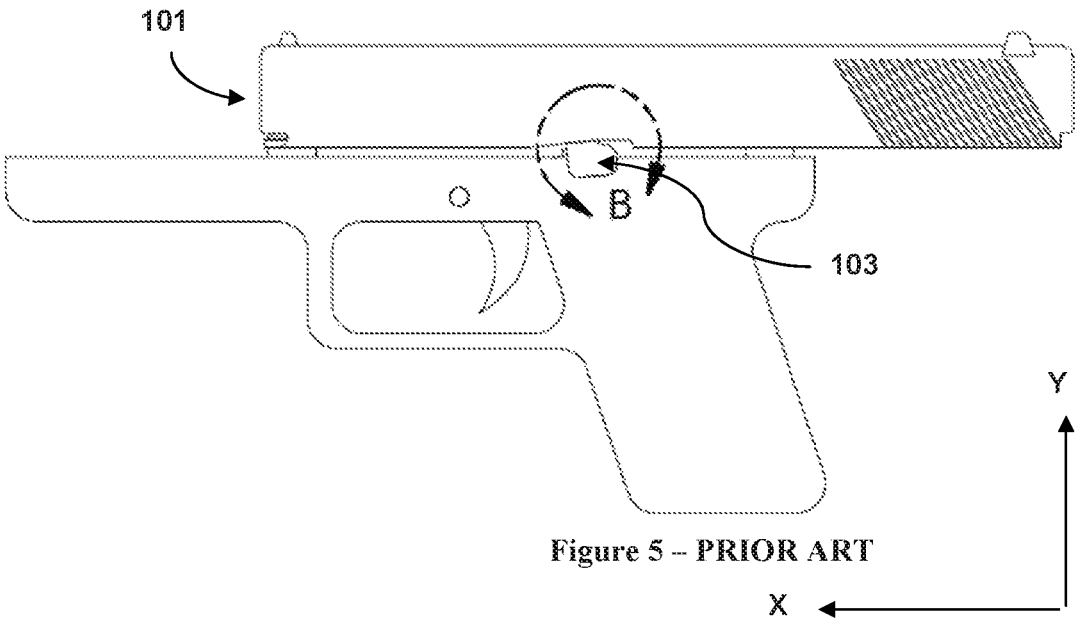
Figure 5 – PRIOR ART
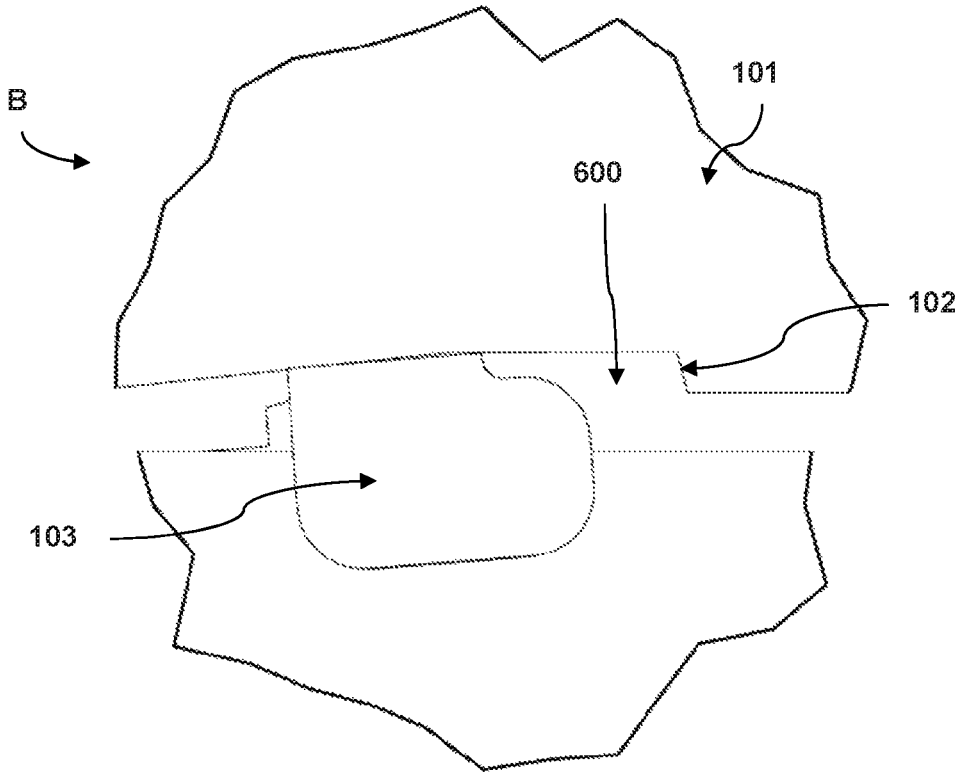
Figure 6 – PRIOR ART

ADJUSTABLE FORCE REPLACEABLE SLIDE NOTCH SYSTEM

FIELD OF THE INVENTION

The field of the invention is firearm slide lock mechanisms.

BACKGROUND

The background description includes information that may be useful in understanding the present invention. It is not an admission that any of the information provided herein is prior art or relevant to the presently claimed invention, or that any publication specifically or implicitly referenced is prior art.

When a semiautomatic firearm expends its last round of ammunition, a slide of the firearm is locked in the aft position (to aid in reloading) by an upward movement of a thumb-operated slide lock lever which interfaces with a permanent slide notch on the firearm slide.

After an empty magazine is replace by another magazine (containing at least one round of ammunition), the slide is released (to return to its forward most position under a biasing force of a recoil spring (the recoil spring's function/configuration known by those in the art and thus not described)) by the user depressing the thumb operated slide lock lever to the down position. This action "slips" the slide lock lever off of the permanent slide notch. As the slide returns to its forward position, the slide chambers/feeds ammunition from the magazine into a barrel to make the firearm ready for discharge.

The permanent slide notch wears over time and the entire slide must be replaced to restore the slide locking feature of the firearm.

Moreover, the existing slides do not allow for the adjustment of the force at which the recoil spring acts on the slide upon unlocking, thus limiting the adaptability of the firearm for environments that could render the firearm more prone to jamming or malfunction.

Thus, there is still a need for an adaptable slide replacement mechanism that reduces the need to replace entire slide and is adaptable to the needs of the user.

SUMMARY OF THE INVENTION

One objective of the present invention is to provide an easily replaceable (as well as relatively inexpensive) slide notch so as to prevent the costly replacement of the entire slide when its permanent Slide notch wears out. Another objective is to allow for inexpensive/replaceable performance modifications of the slide notch (e.g.—filing down the slide notch to make the weapon automatically chamber a first round of a magazine when the magazine is inserted forcefully into the weapon (commonly known as a "slam load" or an "automatic slide release" by those in the art)).

Additionally, a further objective of the systems and methods of the inventive subject matter is to offer alternate notch geometries which affords the user the option of increasing recoil spring compression when the slide locks in the aft position (increasing the spring's potential energy) and therefore increase ammunition chambering/feeding reliability.

The inventive subject matter provides apparatus, systems and methods in which a replaceable slide notch component can be inserted and removed from a cavity in a slide component such that a user can change the slide notch surface of a firearm without having to replace the entire slide.

In embodiments of the inventive subject matter, a replaceable slide notch component is dimensioned to be inserted and secured within a corresponding cavity in a slide component. The replaceable slide notch component includes a slide notch surface that, when the replaceable slide notch component is installed within the cavity, aligns with the slide lock lever of the firearm frame to lock the slide when ammunition is exhausted.

The replaceable slide notch component can be installed within the cavity of the slide via a plug and spring mechanism that fits into a cavity of the replaceable slide notch component and, when inserted into the slide's cavity, into a corresponding locking blind hole of the slide to secure the replaceable slide notch component in place. The corresponding shapes of the replaceable slide notch component and the cavity also secure the replaceable slide notch component against lateral movement. In other embodiments, a spring with a conical end is used instead of a plug-and-spring combination.

In embodiments of the inventive subject matter, the slide notch surface of the replaceable slide notch component is positioned to correspond to the default position of the default slide of the firearm.

In embodiments, the slide notch surface of the replaceable slide notch component is disposed such that the slide is locked at a further rearward position than the default. In these embodiments, the recoil spring of the firearm exerts a greater force on the slide when the slide is unlocked.

In embodiments of the inventive subject matter, the replaceable slide notch component includes a first slide notch surface on one end and second slide notch surface on a second end such that the replaceable slide notch component can be inserted for either the first or second slide notch surface to align with the slide lock lever of the firearm. To change the engaging slide notch surface, the replaceable slide notch component can be removed from the slide's cavity, rotated, and reinserted.

Various objects, features, aspects and advantages of the inventive subject matter will become more apparent from the following detailed description of preferred embodiments, along with the accompanying drawing figures in which like numerals represent like components.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

BRIEF DESCRIPTION OF THE DRAWING

FIG. 1 is a side view of a typical prior art semiautomatic firearm.

FIG. 2 is a detailed view of Section A of FIG. 1.

FIG. 3 is a side view of the firearm of FIG. 1 in an out-of-ammunition state.

FIG. 4 illustrates a worn permanent slide notch of the firearm of FIG. 1.

FIG. 5 is a side view of the prior art firearm of FIG. 1 in a fully recoiled state.

FIG. 6 is a detailed view of Section B of FIG. 5.

DETAILED DESCRIPTION

Figures 7A, 8:
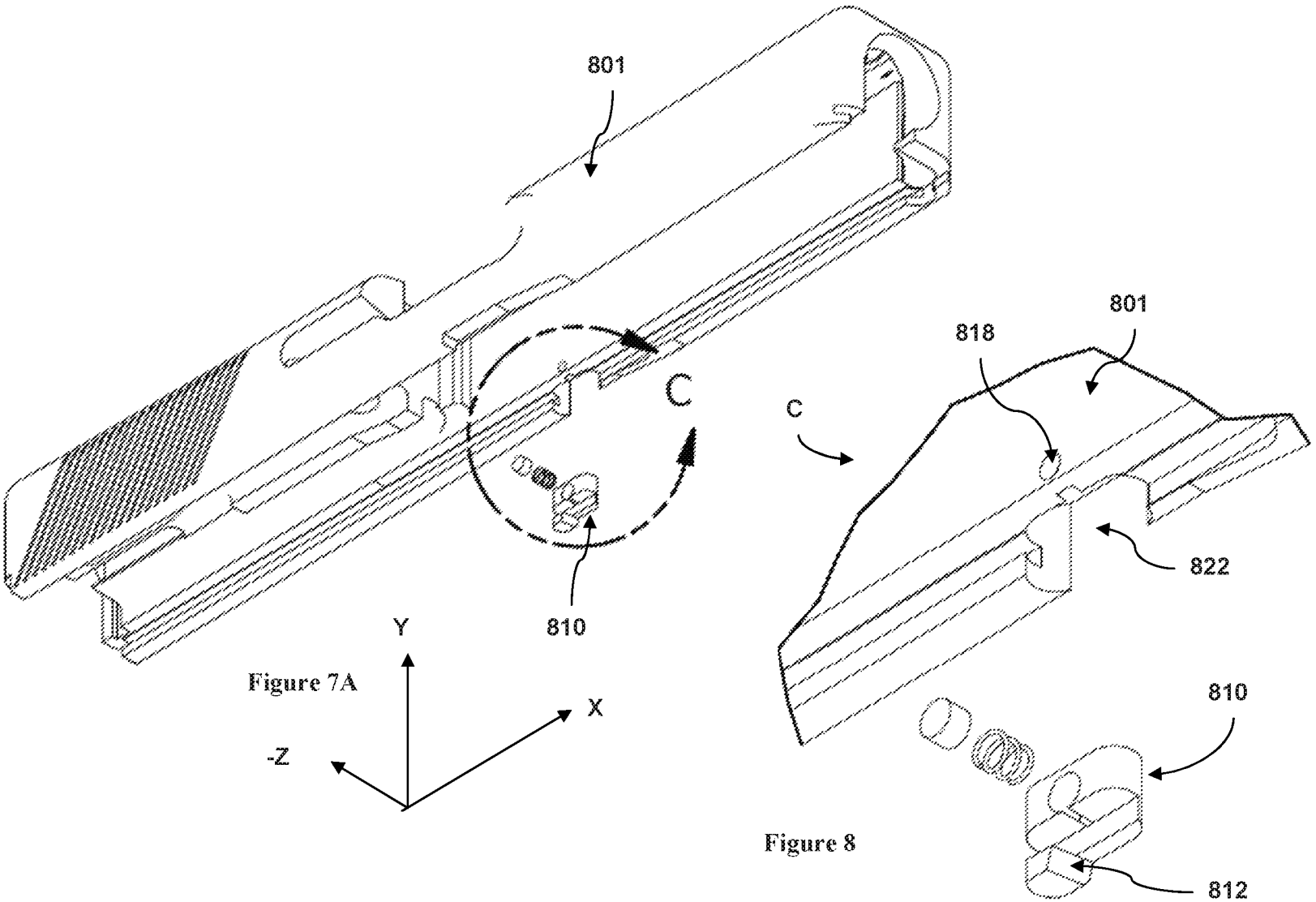
FIG. 7A illustrates an exploded view of the components of the slide and the replaceable slide notch component, according to embodiments of the inventive subject matter.
FIG. 8 is a detailed view of Section C of FIG. 7A.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIG. 1 illustrates a prior art semiautomatic firearm 100 incorporating a slide 101 and frame 104. The frame 104 further comprises a thumb operated slide lock lever 103. As seen in the zoomed-in perspective of FIG. 2, the slide 101 further comprises a Permanent Slide Notch 102.

FIG. 3 illustrates the prior art firearm 100 in its out-of-ammunition State. Slide lock lever 103 interfaces with permanent slide notch 102 to hold slide 101 (which is biased in the forward direction by a recoil spring, not shown) in its rearward, locked position to aid in reloading. To release the slide 101, the slide lock lever 103 is pressed down. The forward movement of the slide 101 chambers/feeds ammunition (utilizing the biasing force of the aforementioned recoil spring) after an ammunition magazine is replaced.

FIG. 4 illustrates a the slide notch 102 of FIG. 2, worn down as a result from sustained use of the firearm 100 (referred to herein as worn permanent slide notch 105 for the purposes of clarity). The wear on the slide notch 105 has resulted in a rounded surface, which causes inconsistent or even non-existent locking back of slide 101 after the firearm is out of ammunition, as the slide lock lever 103 simply slides out of contact with the worn permanent slide notch 105. When this occurs, the entire slide 101 has to be replaced, which is expensive.

FIGS. 5 and 6 illustrate the positional relationship of the permanent slide notch 102 and slide lock lever 103 of a typical prior art firearm 100 in its fully recoiled state. As shown by these figures, the relatively large gap 600 (typically greater than 0.25 inch) between the slide lock lever 103 and the permanent slide notch 102 maximizes the probability that the slide 101 will lock back (after all ammunition is expended) even when the firearm is weakly/lightly held. FIG. 6 is a close-up of the section "B" of FIG. 5. In practice, however, weakly held firearms are extremely atypical. As such, for most uses, this large gap is not only unnecessary, but could be modified to increase the firearm's performance.

Figure 7B:
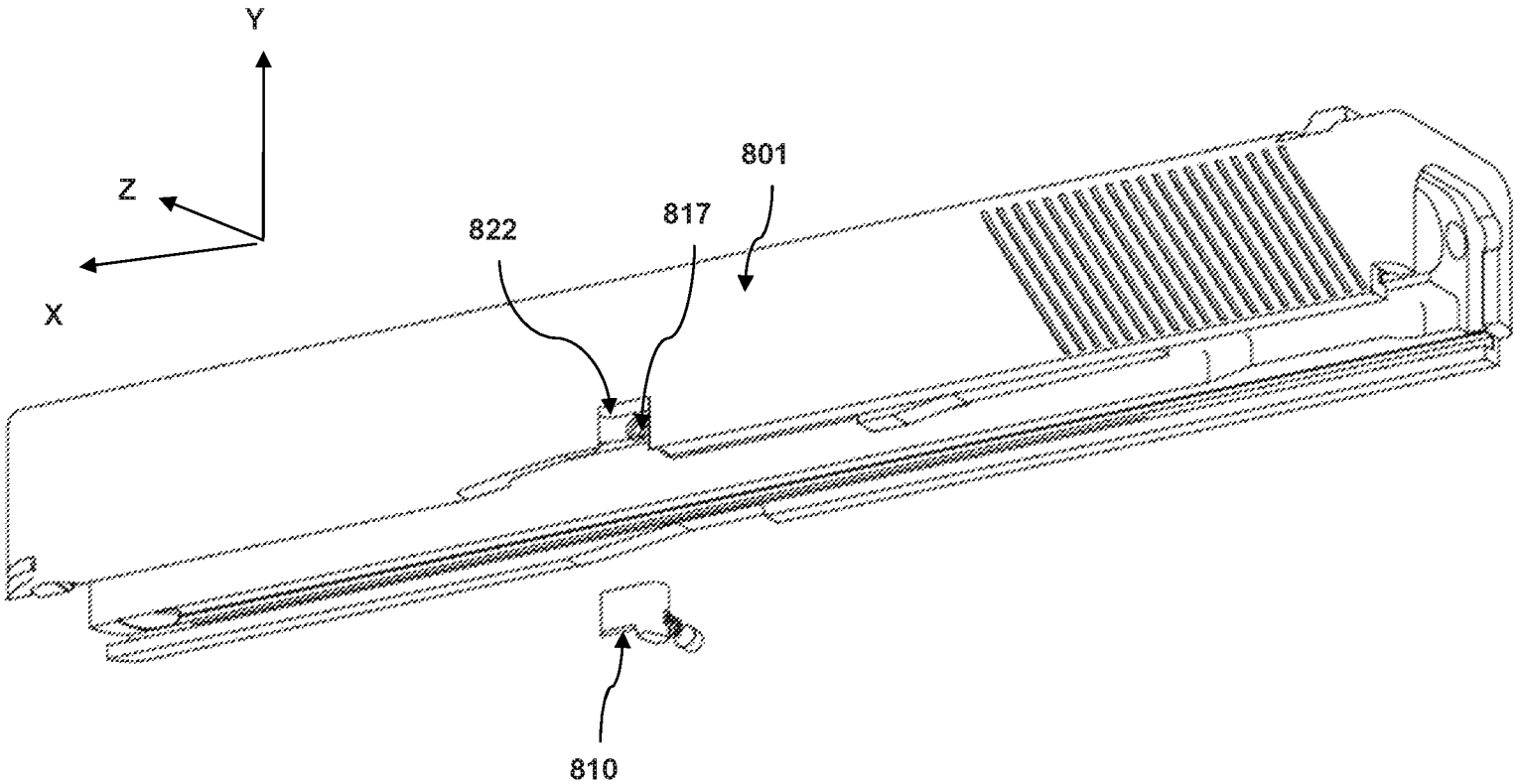
FIG. 7B provides a reverse view of the embodiment of FIG. 7A.
Figure 7C:
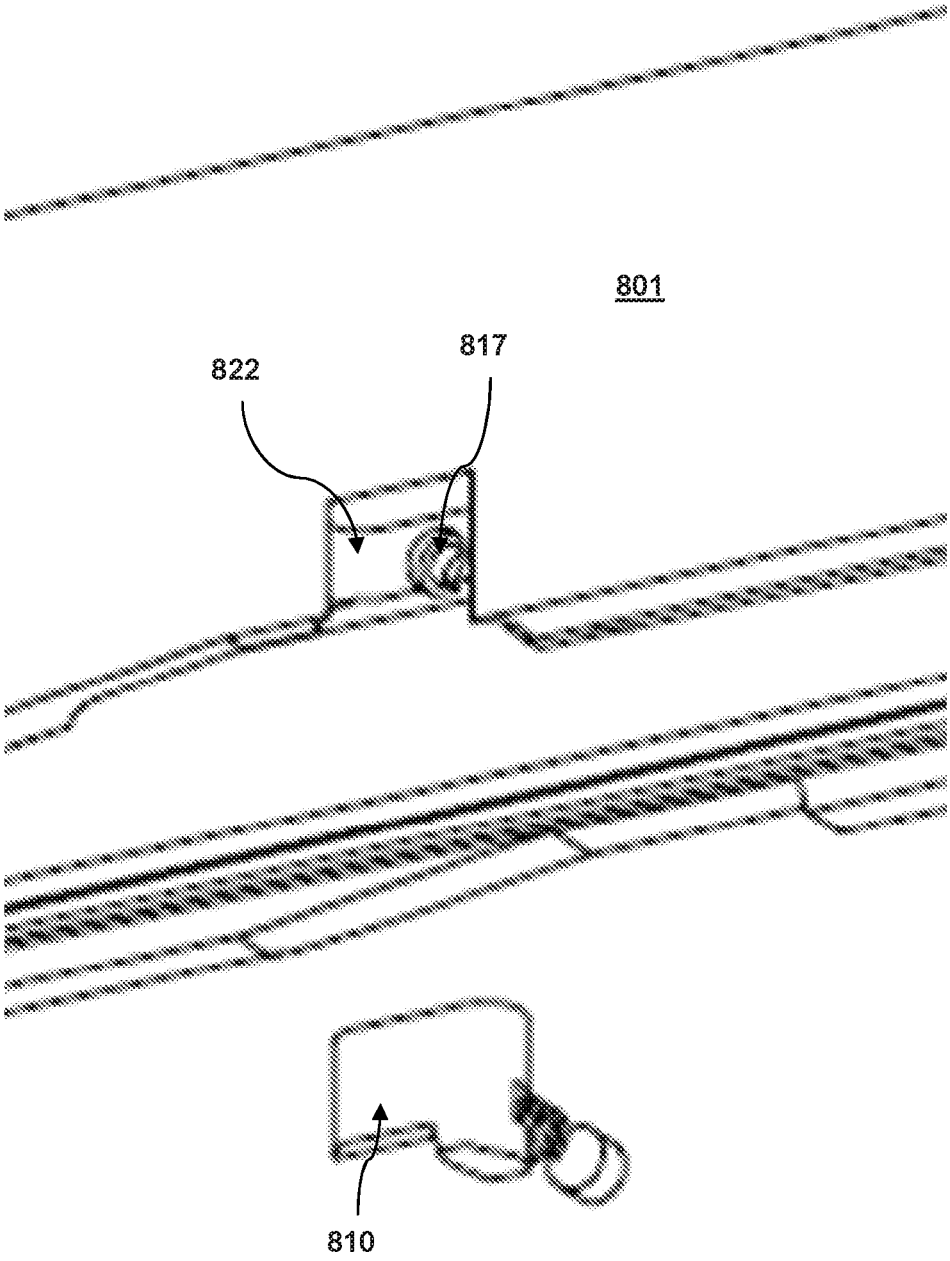
FIG. 7C provides a detailed view of a section of FIG. 7B

FIG. 7A illustrates a slide system according to embodiments of the inventive subject matter. The slide system includes slide 801 having a cavity 822 on the underside of one of the sides of slide 801 that is dimensioned to receive replaceable slide notch component 810 (shown here in an exploded view; also referred to as a "removable slide notch component"), according to embodiments of the inventive subject matter. FIG. 7B provides a view of the slide system shown in FIG. 7A from a reverse view. FIG. 7C provides a close-up view of the cavity 822 from the perspective of FIG. 7B. The cavity 822 is disposed on the side of slide 801 where the slide lock notch would be on a typical slide.

FIG. 8 shows a close-up of the cavity 822 of slide 801 and of the replaceable slide notch component 810 of section "C" of FIG. 7A about to be inserted into cavity 822.

Figure 9:
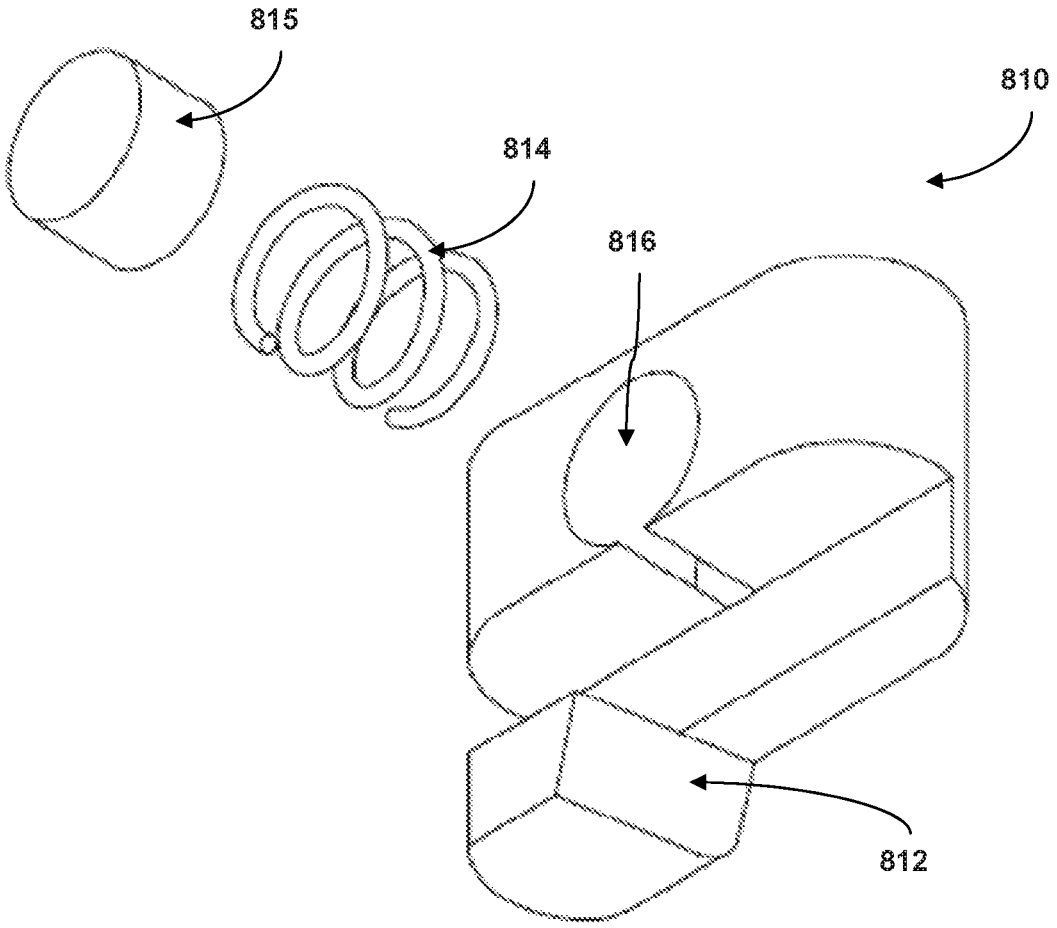
FIG. 9 provides a detailed, exploded view of the replaceable slide notch component, according to embodiments of the inventive subject matter.

FIG. 9 illustrates a close-up, exploded view of the replaceable slide notch component 810. The replaceable slide notch component 810 includes a slide notch surface 812.

Figure 10:
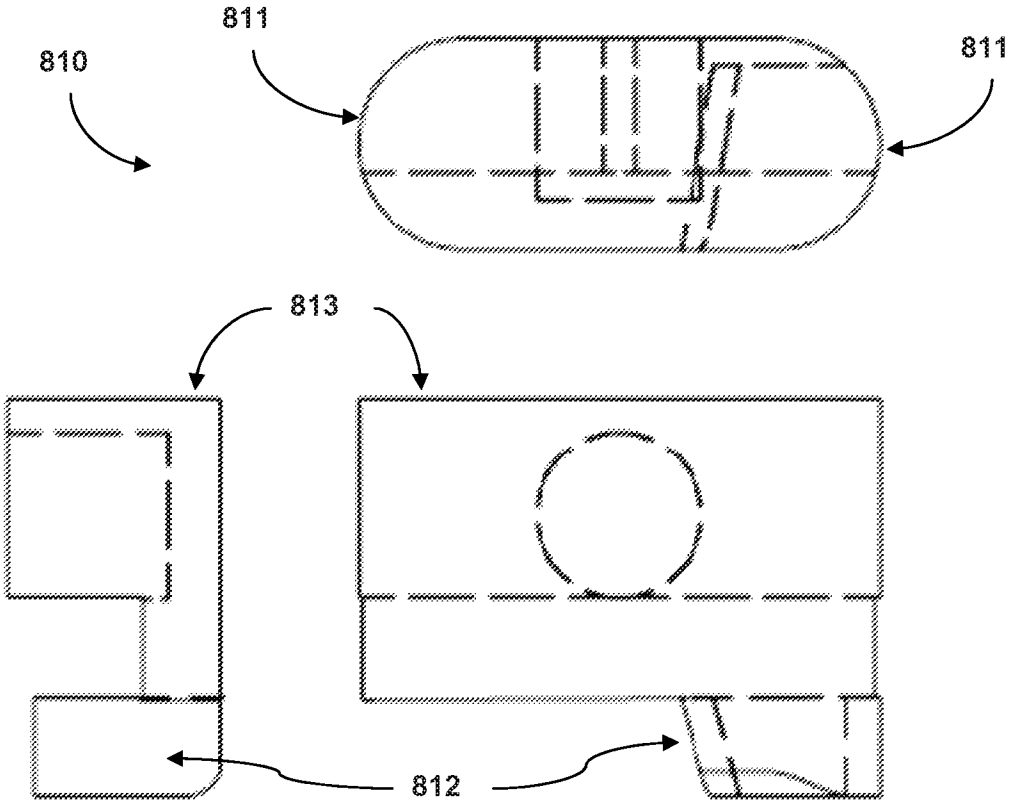
FIG. 10 provides a hidden-line view of the replaceable slide notch component, according to embodiments of the inventive subject matter.

FIG. 10 shows left, top, and front hidden line views of an embodiment of the replaceable slide notch component 810. The rounded ends 811 of the replaceable slide notch component 810 fit into corresponding rounded sections of the cavity 822 (visible in FIGS. 7 and 8), thus anchoring the replaceable slide notch component 810 within cavity 822, such that movement in the X and Z directions (i.e., forward/backward along the length of the slide 801 and transversally) is prevented. The top surface 813 abuts a corresponding surface within cavity 822, preventing further upward movement of the replaceable slide notch component (i.e., in the +Y direction). The plug 815 and plug spring 814 anchors the replaceable slide notch component 810 in the −Y direction (i.e., prevents the replaceable slide notch component 810 from falling downward out of cavity 822).

To install the replaceable slide notch component 810 securely within cavity 822, plug spring 814 and plug 815 would be inserted into plug cavity 816. Plug 815 is depressed (against plug spring's 814 biasing force) completely within the body of the slide notch component 810. This assembly would then be inserted upwardly into cavity 822 of the slide 801. Once fully inserted, the biasing force of plug spring 814 pushes plug 815 outward into a correspondingly sized notch locking blind hole 817, the notch locking blind hole 817 having a depth of less than the length of plug 815 (preferably about half of the length) such that plug 815 extends approximately halfway out of the replaceable slide notch component 810 and bottoms out into the notch locking blind hole 817. Thus, plug 815 locks the replaceable slide notch component 810 within cavity 822, preventing movement in the −Y direction (i.e., downward). As seen in FIGS. 7A-7C, the location of the notch locking blind hole 817 aligns with disassembly hole 818. As discussed in further detail below, the disassembly hole 818 provides access to the notch locking blind hole 817 for the purposes of disassembly.

To uninstall the replaceable slide notch component 810, a suitable plunger (e.g., a straightened paperclip, a skinny nail) is inserted through disassembly hole 818 (diameter of which is smaller than the diameter of notch locking blind hole 817 and plug 815 and axially aligned with the notch locking blind hole 817) of slide 801 to depress plug 815 against the biasing force of plug spring 814 and into plug cavity 816, disengaging the plug 815 from the notch locking blind hole 817 and thus allowing for removal of the slide notch component 810 from cavity 822.

The embodiments of the inventive subject matter illustrated herein incorporate the securing mechanism discussed above involving the plug 815, plug spring 814 and plug cavity 816 to secure the slide notch component 810 within the cavity 822. However, other methods of securing the slide notch component 810 within cavity 822 are contemplated within the scope of the inventive subject matter.

In an alternative to the embodiments illustrated in FIG. 7A-10, the plug cavity 816 is within the slide 801 instead of the replaceable slide notch component 810. In these embodiments, the plug cavity 816 replaces the notch locking blind hole 817 within the slide 801. Likewise, instead of plug cavity 816, the replaceable slide notch component 810 has the slide locking blind hole 817, as well as the disassembly hole 818. In these embodiments, the plug 815 and spring 814 are disposed within the plug cavity 816, with the spring 814 pushing the plug 815 outward. When the replaceable slide notch component 810 is inserted, the spring 814 pushes the plug 815 into the locking blind hole 817 of component 810, locking it in place. To disengage the component 810 from the cavity 822, the plunger is introduced into the disassembly hole 818 of the replaceable slide notch component 810 to compress the spring 814 until the plug 815 is fully removed from the locking blind hole 817. In these embodiments, the disassembly hole 818 is on the "outside" of the slide 801 when the replaceable slide notch component 810 is installed within cavity 822.

Figure 11:
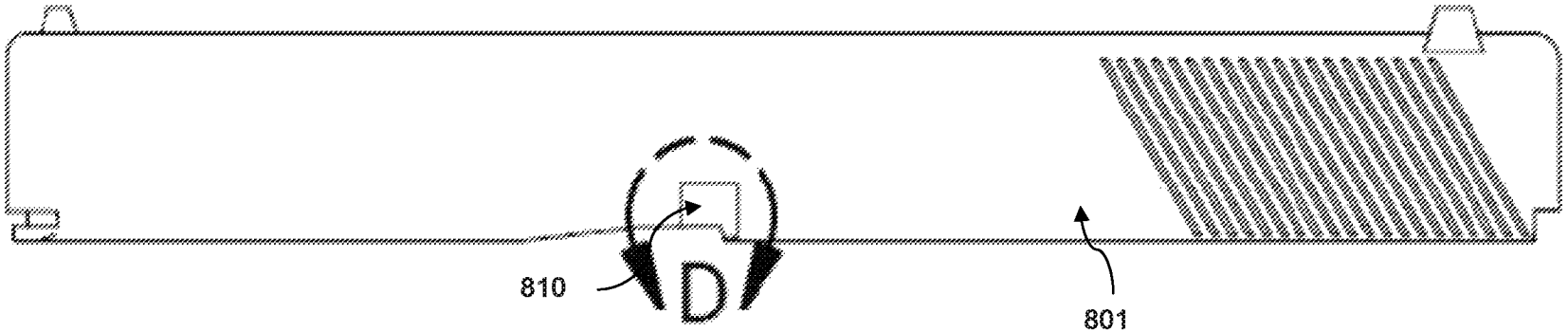
FIG. 11 is a side view of an assembled slide system, with the replaceable slide notch component inserted within the slide cavity, according to embodiments of the inventive subject matter.
Figure 12:
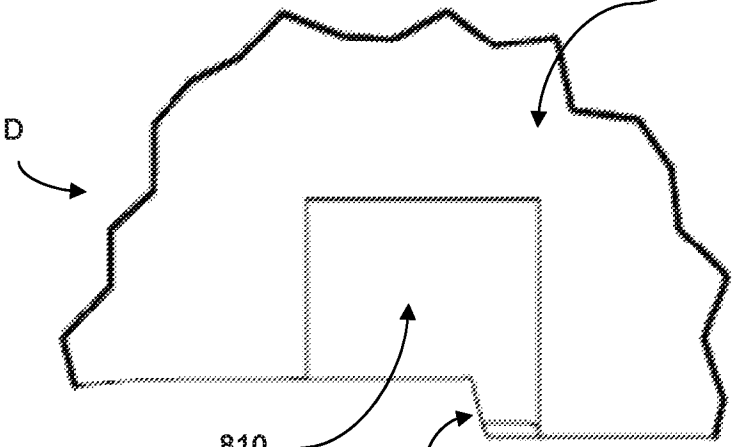
FIG. 12 is a detailed view of Section D of FIG. 11.

FIGS. 11 and 12 illustrate the replaceable slide notch 810 of the embodiments of FIGS. 7-10 installed within the cavity 822 of slide 801. In this embodiment, the location of the slide notch surface 812 on component 810 is disposed such that, when installed within the cavity 822 of slide 801, it would be disposed along the length of the slide 801 at the same location as a default permanent slide notch 102 of a slide 101 (i.e., at the same position relative to the front and rear of the firearm as the default position of the notch 102 of the original slide 101 of the firearm as specified by the manufacturer). Therefore, the assembled slide 801 with the installed component 810 would behave in the same manner during use of the firearm as the "default" prior art slide 101 with the permanent notch 102. This means that, after expending all of the ammunition in the firearm, the notch surface 812 would come into contact with the slide lock lever 103 to lock the slide 801 in place at the same position relative to the length (along the X-direction) of the firearm as the default original slide 101.

Figure 13:
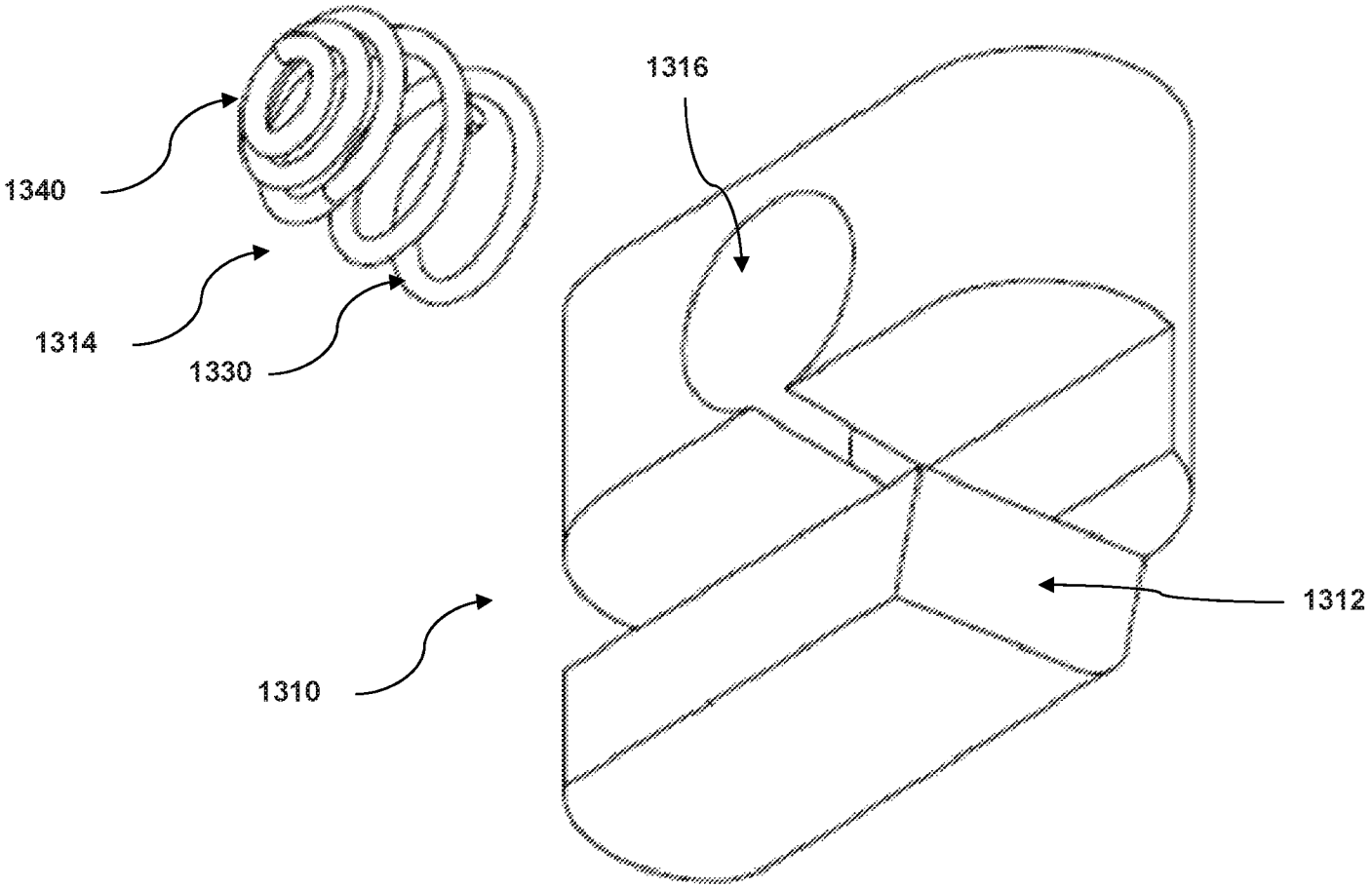
FIG. 13 is an exploded, detailed view of a second replaceable slide notch component.
Figure 14:
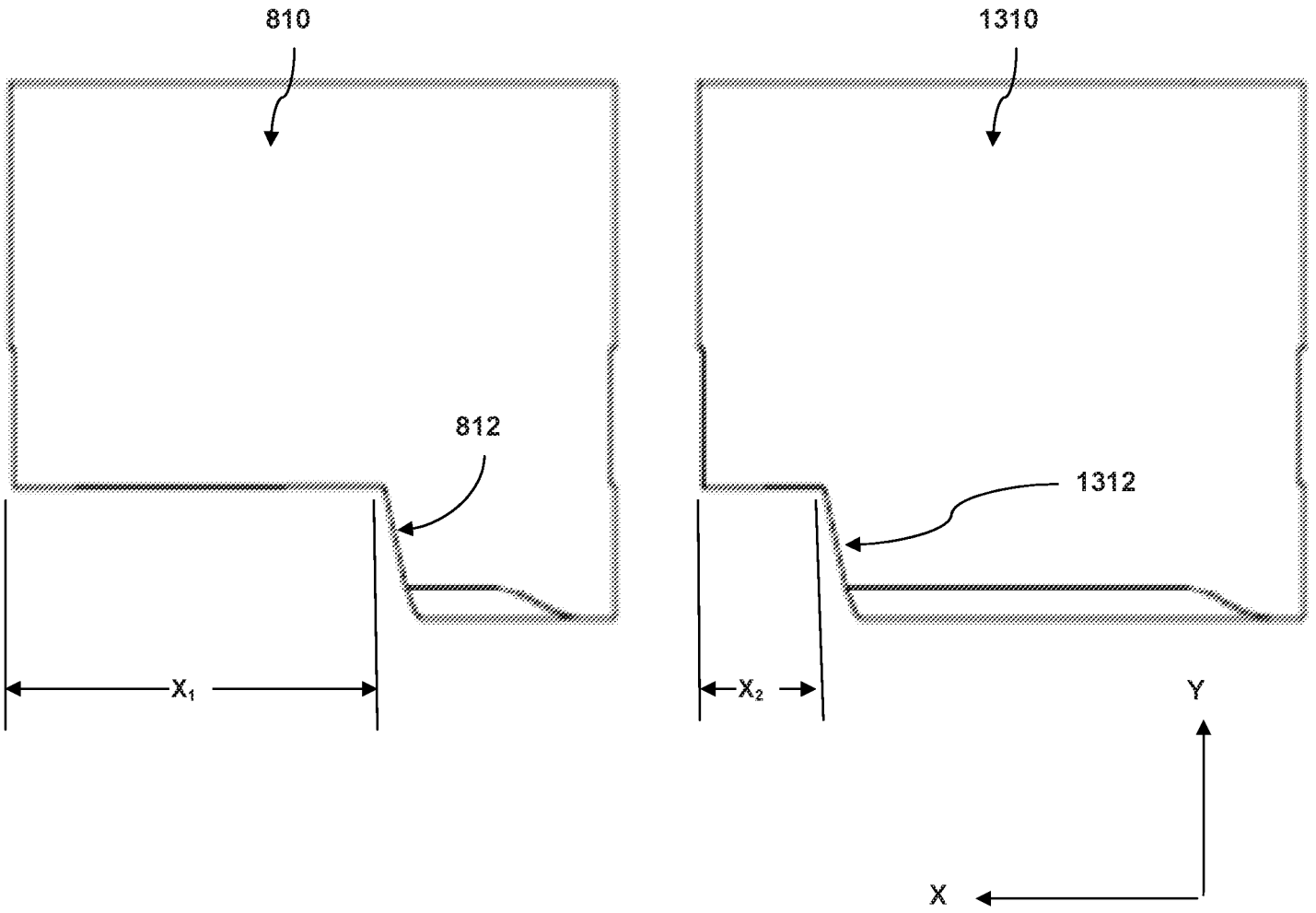
FIG. 14 is a side-by-side view of the replaceable slide notch components of FIGS. 9 and 13.

As noted above, the embodiment of FIGS. 7-12 illustrate a notch surface 822 that mirrors the location of the notch 102. FIG. 13 shows a replaceable slide notch component 1310 having a notch surface 1312 disposed further forward than the notch surface 812 of FIGS. 7A-12, according to an embodiment of the inventive subject matter. A side-by-side comparison of the different notch positions of the respective notch surfaces 812 and 1312 of replaceable slide notch component 810 and replaceable slide notch component 1310 is shown in FIG. 14. As seen in FIG. 14, the position of notch surface 812 is at a distance $X_1$ from the front of the slide notch component 810, which is greater than the distance $X_2$ between the position of notch surface 1312 and the front of the notch component 1310. In other words, when installed in a slide 801, the notch surface 1312 will cause the slide 801 to lock further rearward (i.e., in a negative-X direction) than the notch surface 812. Thus, the slide notch surface 1312 is further forward along the X-direction than the notch surface 812, resulting in a slide lock position of the slide that is further back (and thus increasing the recoil of the recoil spring).

Figure 15:
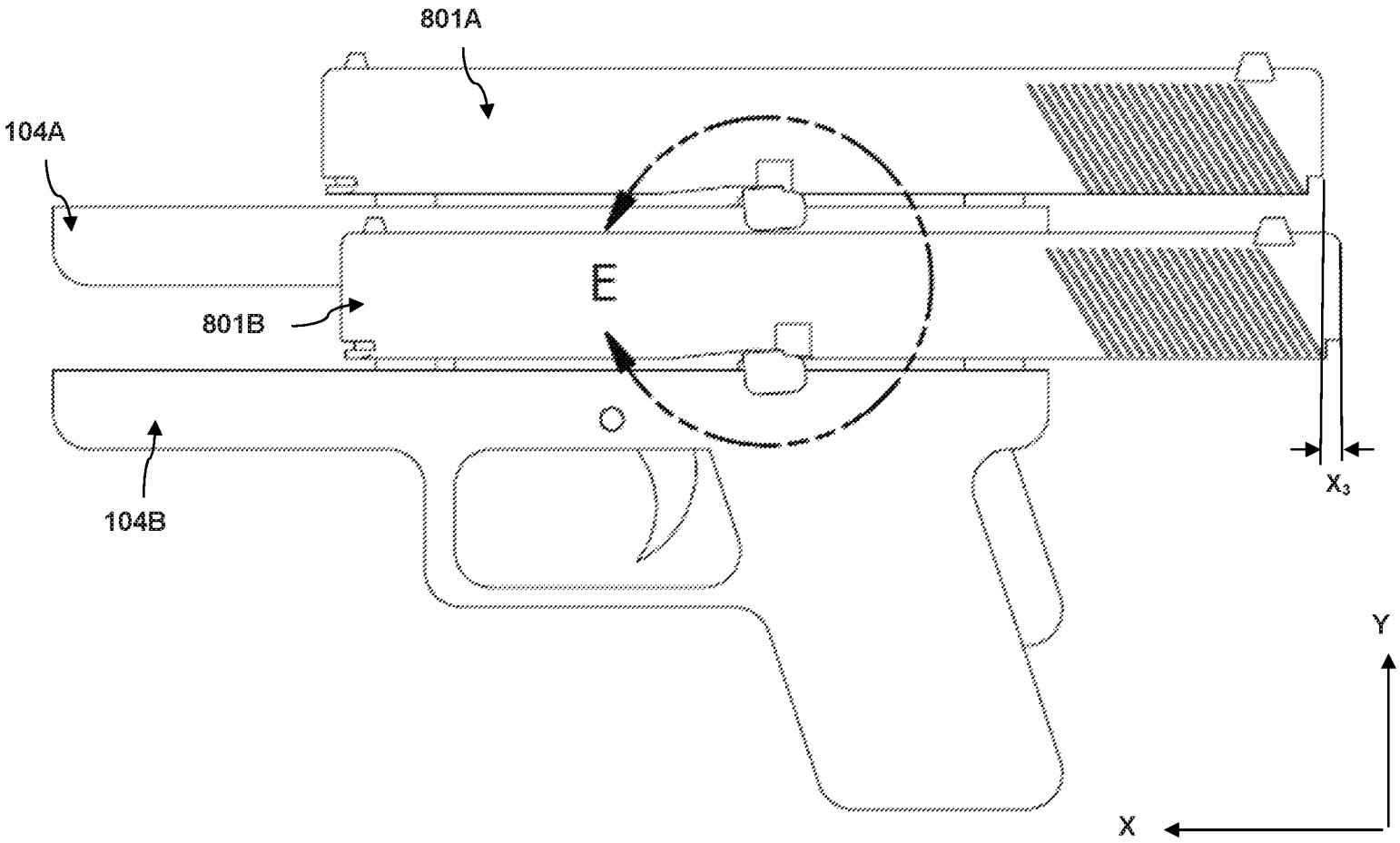
FIG. 15 illustrates a side-by-side comparison of the replaceable slide notch components shown in FIG. 14, installed on firearms.
Figure 16:
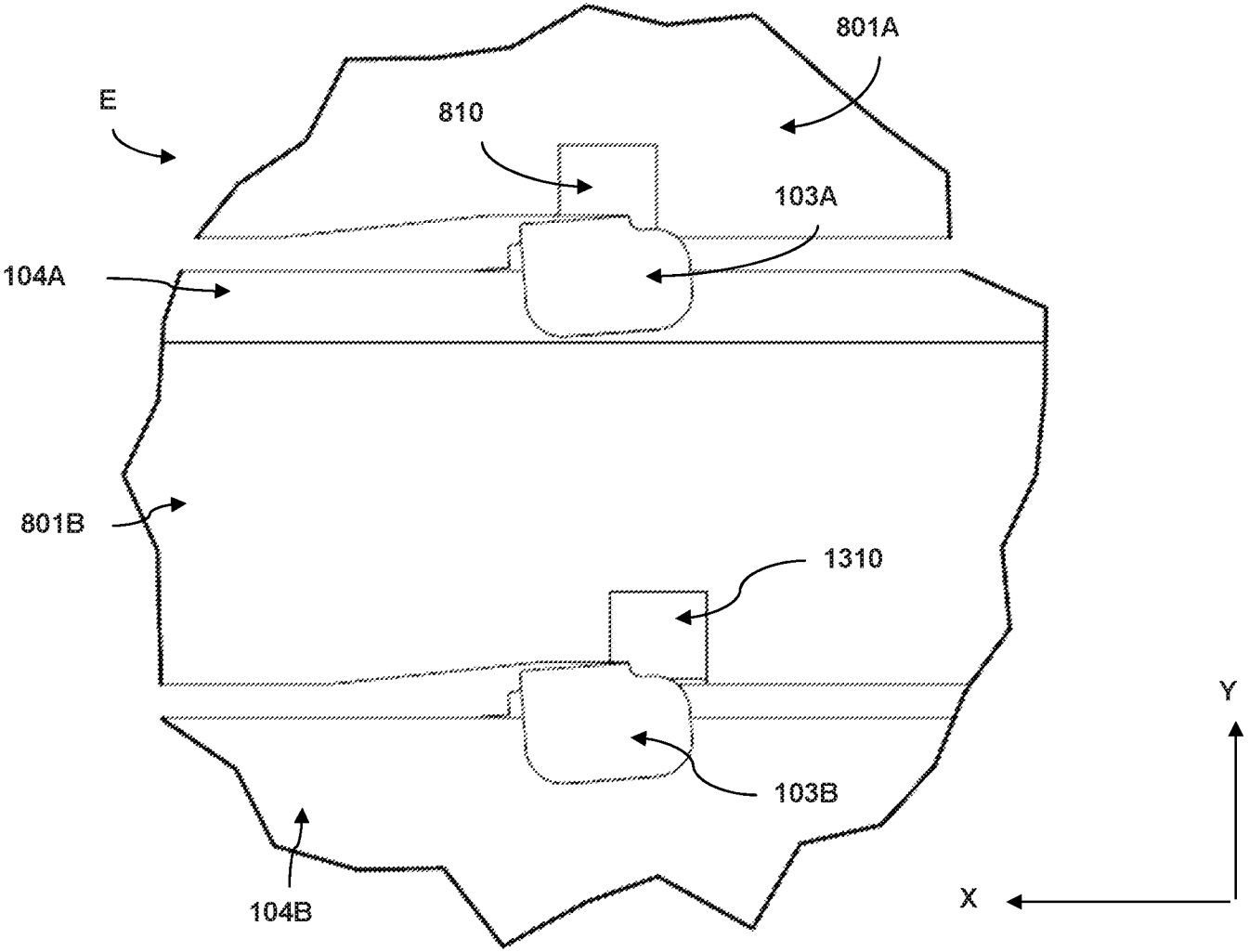
FIG. 16 is a detailed view of Section E of FIG. 15.

The difference in the position of the locked slides 801 when using the slide notch component 810 versus the slide notch component 1310 is illustrated in FIG. 15, with a zoomed-in view of section E provided in FIG. 16. The firearms shown in FIGS. 15 and 16 include identical frames 104, slide lock levers 103, and replaceable slides 801 having cavities 822. For the purposes of clarity, the components of the 'rear' firearm having the replaceable slide notch component 810 will be labeled with an "-A" suffix (e.g., 801A, 103A, etc.) and the components of the 'front' firearm having the replaceable slide notch component 1310 will be labeled with a "-B" suffix (e.g., 801B, 103B, etc.).

Figure 17:
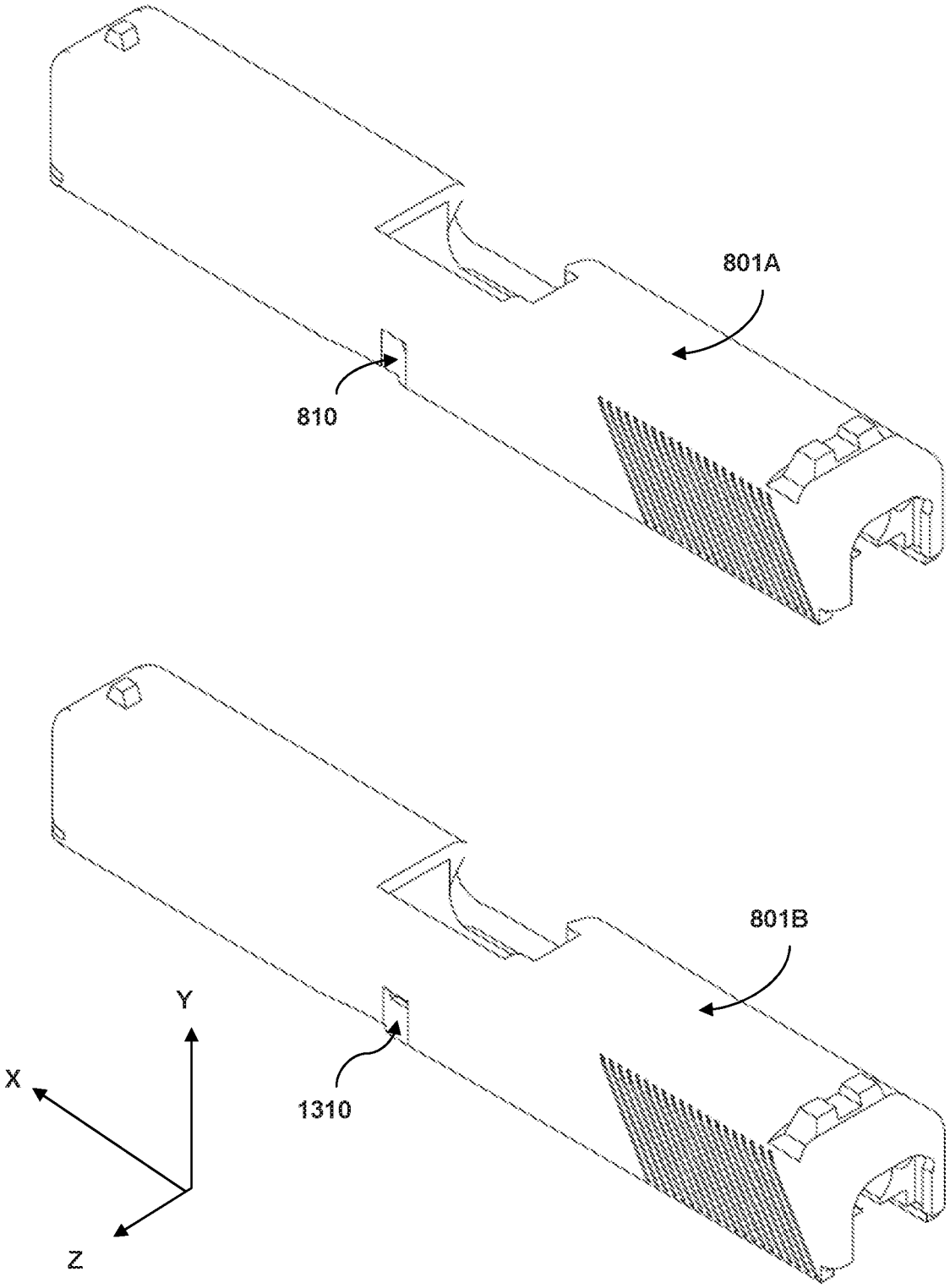
FIG. 17 is an isometric view of the replaceable slide notch components of FIGS. 9, 13 14-15 as installed in slides.

FIG. 17 provides a perspective view of the slides 801A, 801B with the replaceable slide notch components 810, 1310, respectively, installed within.

The further rearwardly locked slide of the firearm using the replaceable slide notch component 1310 with the notch surface 1312 compresses the firearm's recoil spring to a greater degree than the locked slide of the firearm using the replaceable slide notch component 810 (with notch surface 812). The difference between the positions of the slides 801A and 801B of a distance $X_3$ is seen in FIG. 15. Thus, when its slide 801B is released (via release of the slide lock lever 103B), the recoil spring of the firearm using the replaceable slide lock component 1310 exerts greater force available to chamber/feed ammunition from its magazine into its barrel. This increased force is advantageous because it helps prevent jamming should dirt/debris be introduced in to a magazine (e.g.—by dropping a magazine on the ground during battle).

Thus, in situations where jamming is a greater risk, a user could swap the replaceable slide notch component 810 out for replaceable slide notch component 1310. Likewise, where a user prefers to have a "default" feel to the firearm slide locking mechanism, the user can easily replace the replaceable slide notch component 1310 with the replaceable slide notch component 810. This could even be done in the field, with the user taking a single slide 801 and only having to carry the replaceable slide notch components 810, 1310 to make adjustments as needed, without having to carry an entire separate slide assembly.

The embodiment of the replaceable slide notch component 1310 of FIG. 13 also shows an alternative mechanism for securing the replaceable slide notch component 1310 within cavity 822 of slide 801. In this embodiment, lock spring 1314 accomplishes both duties of plug 815 and plug spring 814. The constant diameter end 1330 of lock spring 1314 extend into plug cavity 1316 (which, in this illustrative example, is considered to be identical to plug cavity 816 as the replaceable slide notch components 810, 1310 are considered to interchangeably fit within cavity 822) while the conical/tapering end 1340 extends into the notch locking blind hole 817. The coil body of lock spring 1314 thus functions like plug 815. The conical/tapering end 1340 of lock spring 1314 in turn facilitates interfacing with the aforementioned plunger for disassembly via the disassembly hole 818. While the embodiment of the lock spring 1314 is illustrated in FIG. 13 with the replaceable slide notch component 1310, it is contemplated that the securing mechanism of FIG. 9 using the plug 815 and spring 814 can be used with the replaceable slide notch component 1310. Likewise, the lock spring 1314 of FIG. 13 could be used with the replaceable slide notch component 810 of FIGS. 7A-12 instead of the assembly of spring 814 and plug 815.

In embodiments, the replaceable slide notch component can have a slide notch surface that is disposed further rearward than the default position of slide notch surface 812. In these embodiments, the force exerted by the recoil spring when the slide 801 is released will be less than when the replaceable slide component 810 with slide notch surface 812 is used. This results in less noise, which can be advantageous in reloading situations where the user must be as quiet as possible.

Figure 18:
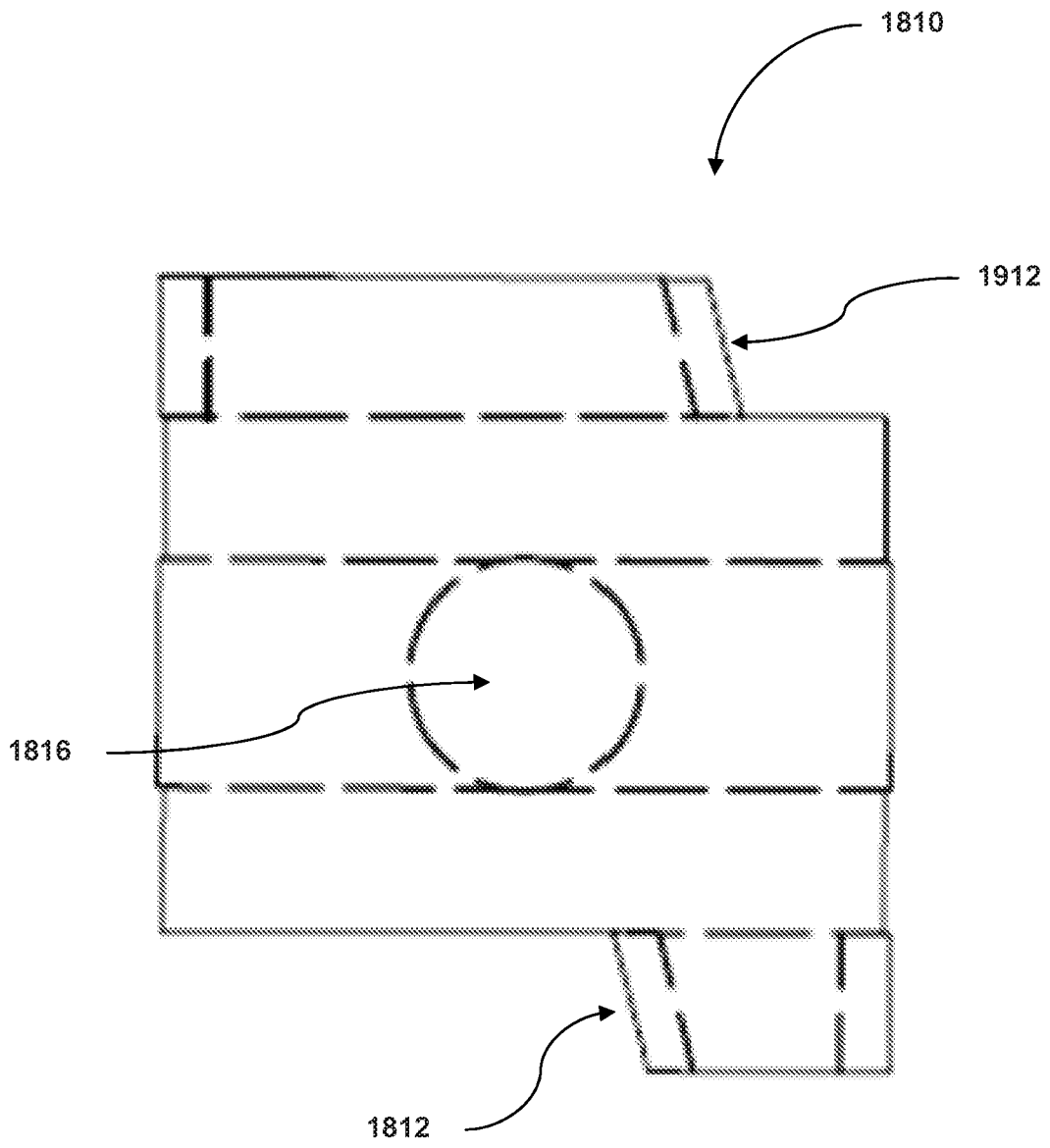
FIG. 18 is a side (hidden line) view of a flippable combination replaceable slide notch component, according to embodiments of the inventive subject matter.

FIG. 18 illustrates a side (hidden line) view of a "flippable" combination replaceable slide notch component 1810, according to embodiments of the inventive subject matter. The replaceable slide notch component 1810 illustrated herein combines both the replaceable slide notch component 810 of FIGS. 7A-12 and the replaceable slide notch component 1310 of FIG. 13 into one single component.

As seen in FIG. 18, the slide notch component 1810 includes slide notch surfaces 1812 and 1912, disposed on opposite sides of the slide notch component 1810. In the illustrative example of this embodiment shown in FIG. 18, the slide notch surface 1812 corresponds (in terms of slide notch surface location along the X-axis of the firearm) to the slide notch surface 812 of replaceable slide notch component 810 and the slide notch surface 1912 corresponds to the slide notch surface 1312 of replaceable slide notch component 1310.

Figure 19:
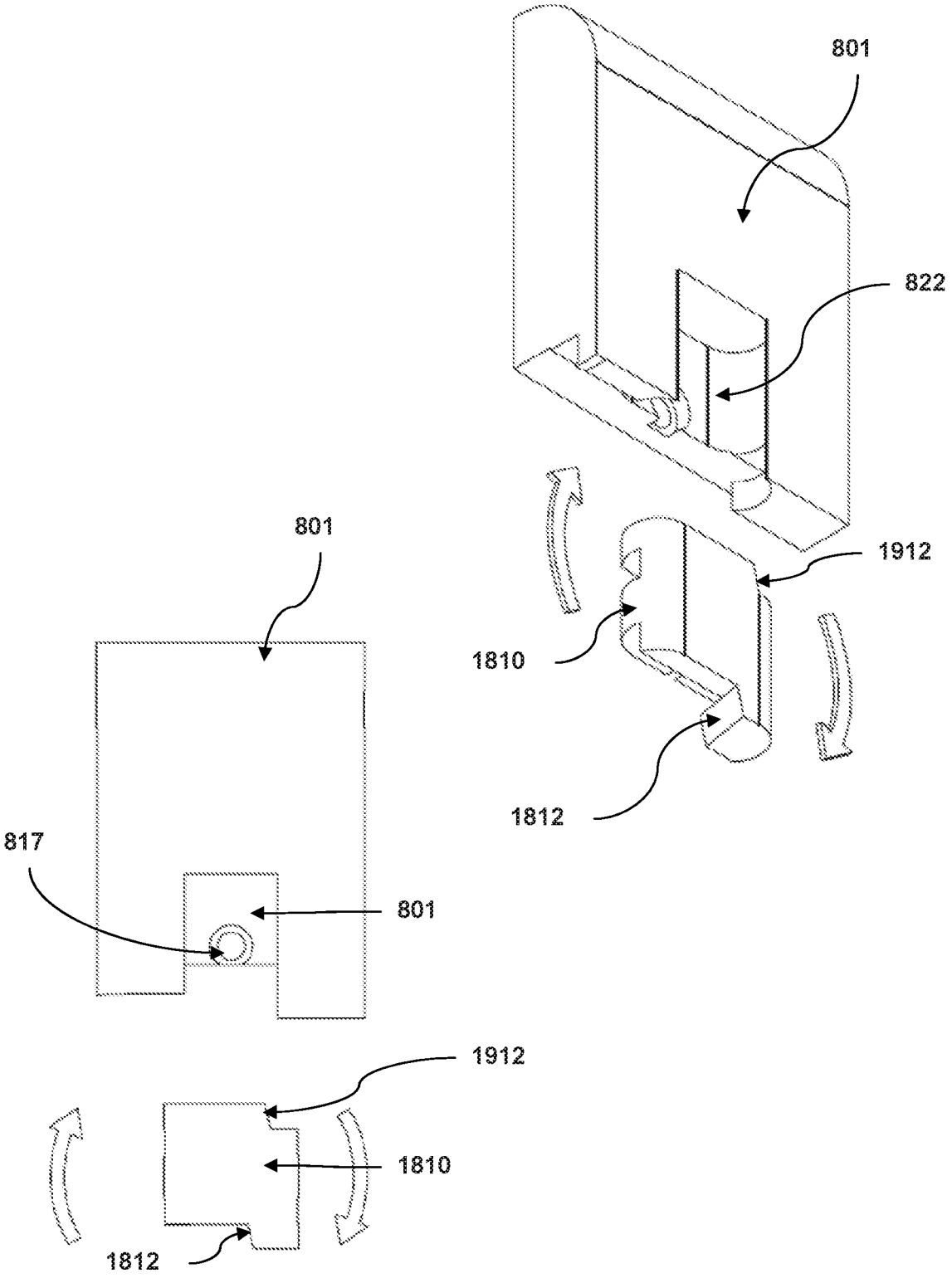
FIG. 19 provides front and isometric views of the replaceable slide notch component of FIG. 18 about to be inserted into the corresponding cavity of the slide such that a first slide notch surface is used.
Figure 20:
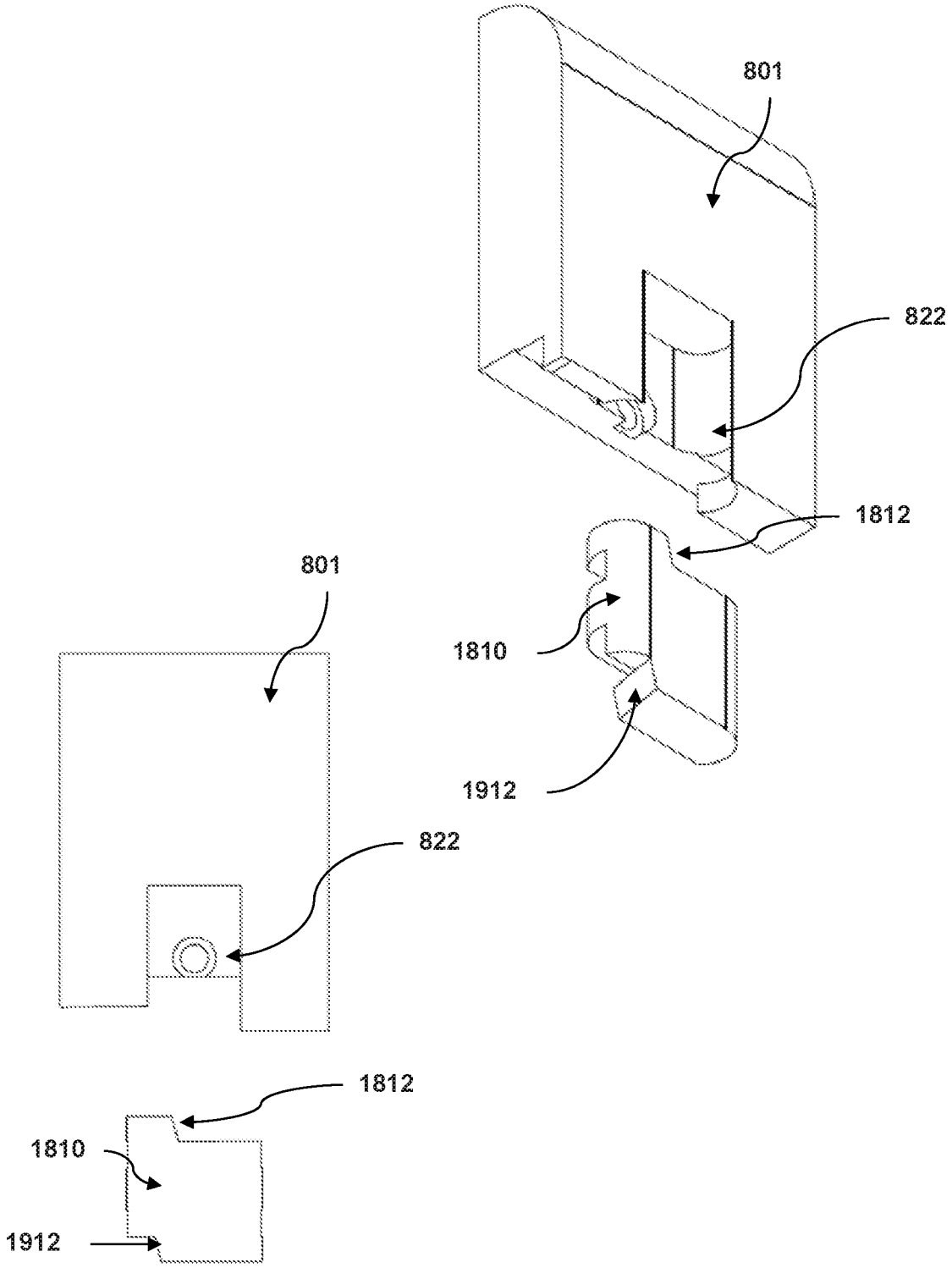
FIG. 20 provides front and isometric views of the replaceable slide notch component of FIGS. 18-19 about to be inserted into the corresponding cavity of the slide after rotation such that the second slide notch surface is used.

FIG. 19 shows the replaceable slide notch component 1810 about to be inserted into the slide 801 such that the slide notch surface 1812 is used. As such, the slide 801 will function in the same way that the slide 801 would function with the replaceable slide notch component 810 inserted as described above. However, if the user wishes to increase the force exerted by the recoil spring as discussed above with regard to replaceable slide notch component 1310, the user can remove the replaceable slide notch component 1810 from cavity 822, rotate it 180 degrees (as indicated by the arrows in FIG. 19), and re-insert the replaceable slide notch component 1810 into cavity 822 in this orientation as shown in FIG. 20 such that the slide notch surface 1912 is now used to engage the slide lock lever 103. In this embodiment, the replaceable slide notch component is essentially axially rotatable about its plug cavity 1816.

In the embodiment shown in FIGS. 18-20, the replaceable slide notch component 1810 has two slide notch surfaces 1812, 1912 disposed 180 degrees from each other. However, it is contemplated that further embodiments of the inventive subject matter can comprise alternate catches (additional slide notch surfaces) indexed appropriately about plug cavity 1816 (e.g.—four catches indexed at 90 degrees, three catches indexed at 120 degrees, etc.). The additional slide notch surfaces can be duplicative of the position of slide notch 1812 and/or 1912, or in other positions along the X-direction of the firearm (when installed to function with slide lock lever 103).

The embodiment shown in FIGS. 18-20 includes slide notch surfaces 1812, 1912 that respectively mirror the positions along the X-direction of the firearm of the notch surfaces 812, 1312, allowing the user to change the force at which the recoil spring pushes the slide 801 forward when it is unlocked. In other embodiments, it is contemplated that the replaceable slide notch component 1810 can include both slide notch surfaces 1812, 1912 at the same position along the X-direction of the firearm when installed within cavity 822 (i.e., both corresponding to the position of slide notch surface 812, slide notch surface 1312, or another position along the X-direction). In these embodiments, the slide notch surfaces 1812, 1912 essentially serve as duplicative slide notch surfaces that can function as replacements for one another. Therefore, if one of the slide notch surfaces 1812, 1912 becomes damaged, the user can remove and rotate the replaceable slide notch component 1810 and use the other of the slide notch surfaces 1812,1912 (that is not worn or damaged), while maintaining the same force exerted by the recoil spring as before. This allows for the continued, consistent operation of the firearm without requiring a whole new slide assembly.

Figure 21:
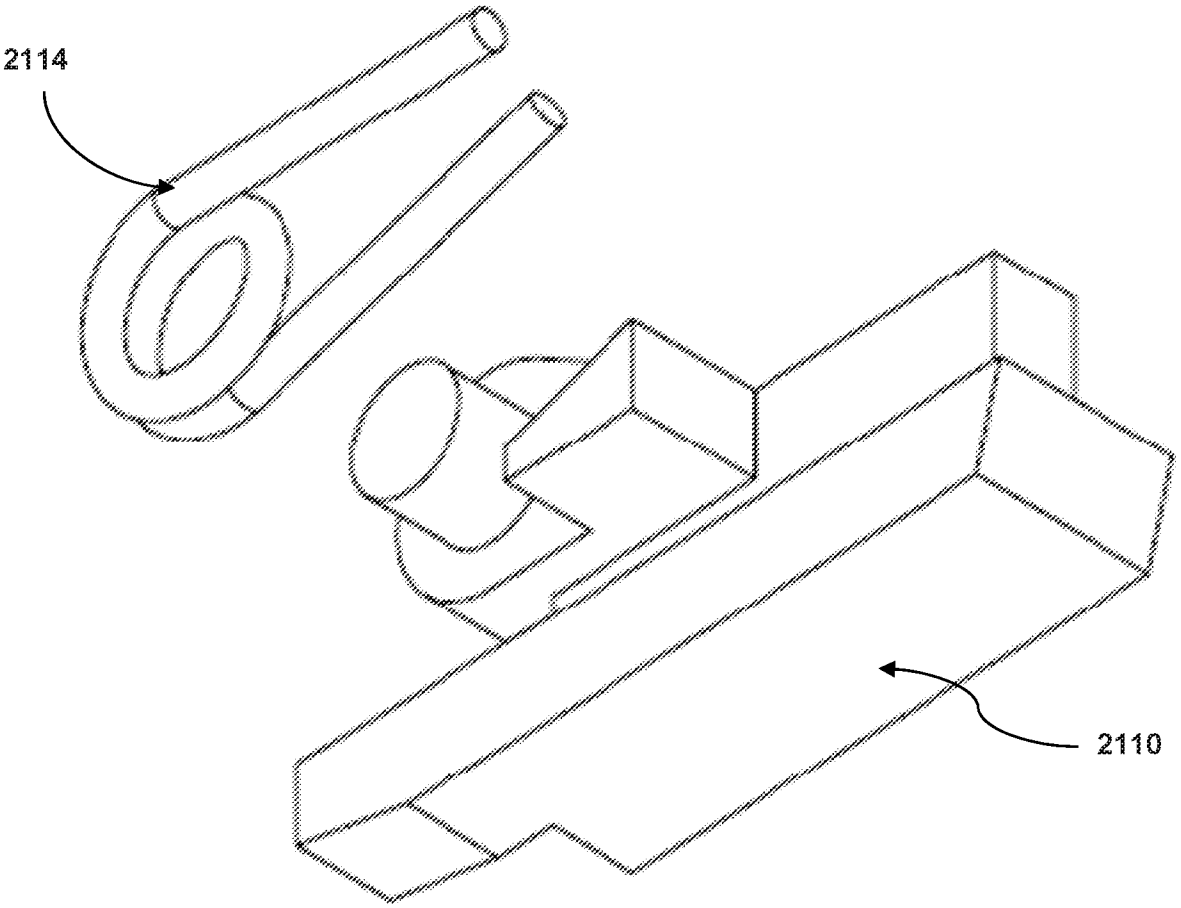
FIG. 21 illustrates a replaceable slide notch and spring of co-owned provisional patent application 62/129,834.

FIG. 21 illustrates the replaceable slide notch component 2110 and its spring 2114 of commonly-owned U.S. provisional application 62/129,834. The replaceable slide notch component of that application and its corresponding cavity in that system's slide requires extensive (i.e.—expensive) miniature machining to manufacture to perform the functions discussed therein. As such, the embodiments discussed with respect to FIGS. 7A-20 are considered preferred embodiments to provide the advantages discussed herein.

It is contemplated that the components of the inventive subject matter described herein can be made from suitable materials (e.g.—sheet metal, steel, steel alloys, polymers (plastics), etc.) and processes (e.g.—machining, 3D Printing, Metal Injection Molding, sheet metal folding, etc.) known by those in the art.

Alternative embodiments and/or uses of the methods and devices described above and modifications and equivalents thereof are intended to be included within the scope of the present invention. These embodiments could include any objects which utilize easy assembly/disassembly methods (i.e.—screws, pins, cotter pins, partial turn locking means, magnets, locking washers, locking nuts, etc.).

Although only a semiautomatic handgun is described, the invention could be readily adapted to be utilized in alternate types of firearms (i.e.—(semi and fully automatic) rifles, shotguns, cannons, etc.).

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A replaceable firearm slide notch system, comprising:

a slide configured to be installed on a firearm, the slide having a cavity; and a removable slide notch component dimensioned to be inserted within the cavity in a first direction to detachably couple with the slide, the removable slide notch component including a slide lock notch surface disposed on a first side, the slide lock notch surface aligned to contact with a corresponding slide lock lever of a firearm when the slide lock lever is pivoted into a lock position;

wherein:

the slide lock notch surface is positioned at a first position along the length of the slide such that the slide is locked at a first locked position when the slide lock lever engages with the slide lock notch surface; and the first position is located forward of a default notch position.

2. The slide notch system of claim 1, further comprising:

a second removable notch component dimensioned to fit within the cavity to detachably couple with the slide, the second removable notch component including a second slide lock notch surface aligned to contact with the slide lock lever of the firearm when the slide lock lever is pivoted into the lock position;

wherein the second slide lock notch is positioned at a second position along the length of the slide and the second position is different from the first position such that the slide locks at second locked position when the slide lock lever engages the second slide lock notch surface and the second locked position is different from the first locked position.

3. The slide notch system of claim 1, the removable slide notch component further comprising:

a second slide lock notch surface disposed on a second side, the second slide lock notch surface aligned to contact the slide lock lever of the firearm when the slide lock lever is in a locked position and the removable slide notch component is inserted into the cavity in a second direction.

4. The slide notch system of claim 3, wherein the slide lock notch surface and second slide lock notch surface are disposed at different rearward positions relative to the slide when the removable slide notch component is inserted into the cavity in the first and second directions, respectively.

5. The slide notch system of claim 1, the removable slide notch component further comprising:

a plug cavity disposed to align with a corresponding locking blind hole of the slide when the removable slide notch component is installed within the cavity; and a plug spring assembly disposed within the plug cavity, the plug spring assembly configured to extend into the locking blind hole when the plug cavity is aligned with the locking blind hole.

6. The slide notch system of claim 5, wherein the plug spring assembly comprises a plug spring and a plug, the plug spring configured to push the plug into the locking blind hole when the plug cavity is aligned with the locking blind hole.

7. The slide notch system of claim 5, wherein the plug spring assembly comprises a plug spring, the plug spring comprising:

a constant diameter end configured to remain disposed within the plug cavity; and a tapering end configured to extend into the locking blind hole when the plug cavity is aligned with the locking blind hole.

8. The slide notch system of claim 5, wherein the slide further comprises a disassembly hole aligned with the locking blind hole, the disassembly hole providing access to the locking blind hole when the removable slide notch component is installed within the cavity.

* * * * *